United States Patent [19]

Callahan et al.

[11] 4,100,400

[45] Jul. 11, 1978

[54] GASOLINE PUMP PRICE ENCODER

[75] Inventors: John A. Callahan, Houston; Allan S. Ottenstein, Spring, both of Tex.

[73] Assignee: RF Products Corp., Houston, Tex.

[21] Appl. No.: 724,172

[22] Filed: Sep. 17, 1976

[51] Int. Cl.[2] ..... G06M 1/272; B67D 5/22

[52] U.S. Cl. ..... 235/92 FL; 235/92 FP; 235/92 V; 235/92 R; 235/94 A

[58] Field of Search ..... 235/92 FL, 92 FR, 92 V, 235/92 MS, 94 R, 94 A; 222/33, 32, 23

[56] References Cited

U.S. PATENT DOCUMENTS

| | | | |
|---|---|---|---|
| 3,027,048 | 3/1962 | Rapisarda | 235/92 FL |
| 3,612,393 | 10/1971 | Jones | 235/92 FL |
| 3,666,928 | 5/1972 | Burke et al. | 235/92 FL |
| 3,729,996 | 5/1973 | Metz | 235/92 FL |
| 3,818,192 | 6/1974 | Anderson | 235/92 FL |
| 3,846,624 | 11/1974 | Kawanabe | 235/92 MS |
| 3,951,307 | 4/1976 | Muller et al. | 235/92 FP |
| 3,984,661 | 10/1976 | Mayer et al. | 235/92 FL |

*Primary Examiner*—Joseph M. Thesz

*Attorney, Agent, or Firm*—Flehr, Hohbach, Test, Albritton & Herbert

[57] ABSTRACT

Price encoder for delivering pulses corresponding to the price of gasoline or other liquid petroleum products dispensed by a pump. The encoder is removably mounted on the existing mechanical price computer in the pump and includes an input gear for engaging a drive gear on the computer. A pulse generator coupled to the input gear provides pulses at a higher rate than required for the output, and this pulse rate is reduced by a counter to provide a desired number of pulses per unit price. The counter is reset in response to the application of operating power to eliminate errors which might otherwise arise when the pump is reset.

6 Claims, 3 Drawing Figures

GASOLINE PUMP PRICE ENCODER

BACKGROUND OF THE INVENTION

This invention pertains generally to pumps for dispensing gasoline and other liquid petroleum products and more particularly to an encoder for providing an output signal corresponding to the price of the product dispensed.

Pumps of the type commonly used for dispensing gasoline and other liquid petroleum products generally include a flow responsive mechanical computer for determining the total sales price or cost of the product dispensed. Such computers generally include digital display wheels and a Geneva movement for advancing the wheels in accordance with the flow of product through the pump. Examples of such computers are the Model 56 and Model 0.101 gas pump computers manufactured by Veeder Root.

In the past, there have been attempts to attach devices to the price volume computers of gasoline pumps to provide digital electrical signals corresponding to the price of the gasoline dispensed. The signals are transmitted to suitable equipment for totalization, recordation or other desired processing. The devices heretofore provided for this purpose have been subject to a number of problems and disadvantages, including inaccuracy and requiring frequent maintenance. Moreover, the devices have had to be specially adapted for different types of computers, and since the devices remain connected to the computers at all times, they can generate spurious pulses when the pumps are reset.

SUMMARY AND OBJECTS OF THE INVENTION

The invention provides a highly accurate price encoder which can be utilized with a wide variety of existing price computers. The encoder is removably mounted on the computer and includes an input gear for engaging a drive gear on the computer. A pulse generator coupled to the input gear provides pulses at a higher rate than required for the output, and this pulse rate is reduced by a counter to provide a desired number of pulses per unit price. The counter is reset each time that operating power is applied to eliminate errors which might otherwise arise when the pump is reset.

It is in general an object of the invention to provide a new and improved price encoder for use in pumps for dispensing gasoline and other liquid petroleum products.

Another object of the invention is to provide a price encoder of the above character which is removably mounted and can be utilized with the price computers of existing gas pumps.

Another object of the invention is to provide a price encoder of the above character which produces pulses at a higher rate than required for the ultimate output signal.

Another object of the invention is to provide a price encoder of the above character utilizing a counter which is reset in response to the application of operating power to eliminate errors when the pump is reset.

Additional objects and features of the invention will be apparent from the following description in which the preferred embodiment is set forth in detail in conjunction with the accompanying drawings.

DESCRIPTION OF THE PREFERRED EMBODIMENT

Figure 1:
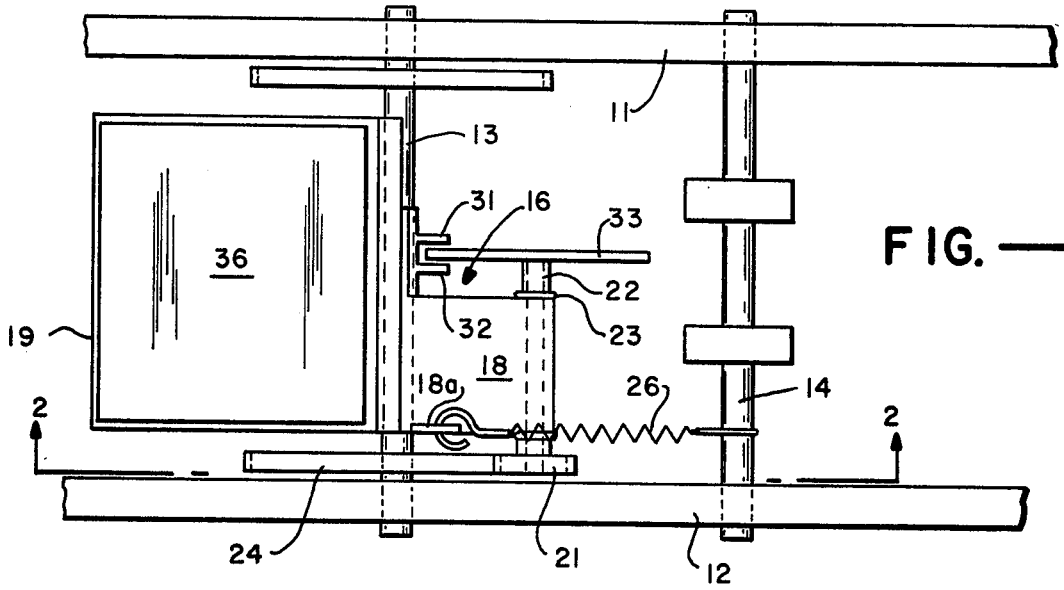
FIG. 1 is a fragmentary top plan view of one embodiment of a price encoder incorporating the invention mounted on the mechanical price computer of a gasoline pump.
Figure 2:
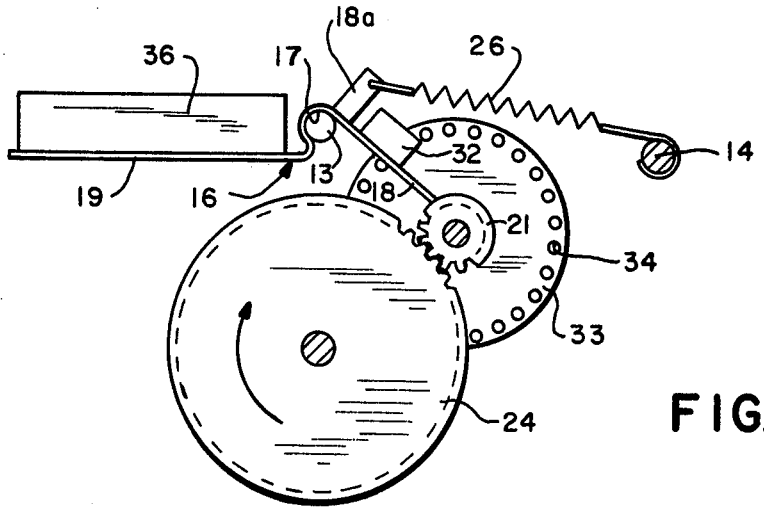
FIG. 2 is a cross-sectional view taken along line 2—2 of FIG. 1.

In FIGS. 1 and 2, the invention is illustrated in conjunction with a mechanical gasoline pump price computer having a pair of side plates 11, 12 and a spacer rod 13 extending between the side plates. The computer is of conventional design and includes digital display wheels driven by a Geneva movement in response to the flow of gasoline to indicate the total cost or price of the gasoline dispensed. The Geneva movement includes a support rod 14 which extends laterally between the side plates.

The encoder includes a base 16 fabricated of a material such as metal or a rigid plastic. The base includes a generally semicylindrical bearing surface 17 engageable with spacer rod 13 for pivotally mounting the encoder on the computer and a pair of generally planar arms 18, 19 which extend from the bearing. As illustrated, the arms diverge away from the bearing to form additional bearing surfaces which permit the base to be mounted on rods of different diameters, and beyond the bearing region arm 19 bends sharply away from arm 18.

An input gear 21 is affixed to one end of a laterally extending shaft 22 which is rotatively mounted in a bearing 23 toward the outer end of arm 18. Gear 21 is positioned to engage and be driven by a drive gear 24 which forms a part of the computer and is driven in accordance with the flow and price of the gasoline. A coil spring 26 extends between a tab **18*a* on arm 18 and support rod 14 and urges the base to pivot in the clockwise direction, as viewed in FIG. 2, thereby maintaining gears 21, 24** in a position driving relationship.

Means is coupled ot input gear 21 for producing electrical pulses at a rate corresponding to the flow of gasoline. This means includes a light source 31, a light sensor 32, and an encoder disc 33 mounted on shaft 22 with a plurality of circumferentially spaced light transmissive windows for alternately permitting and blocking the passage of light from the source to the sensor as the disc rotates. The light source and sensor are mounted on the base and, in the preferred embodiment, comprise a light emitting diode and a photodiode, respectively. The relationship between the pulses produced by photodiode 32 and the flow or price of the gasoline is determined by the ratio of gears 21, 24 and the number of openings in the encoder disc. In the preferred embodiment, these factors are selected to provide a higher pulse rate than the output ultimately desired. For example, for an output of one pulse per penny of gasoline dispensed, the gear ratio and encoder disc might be arranged to provide ten pulses per penny from the photodiode. It will be understood, however, that the gear ratio and number of holes can be chosen to provide any scale factor desired.

Figure 3:
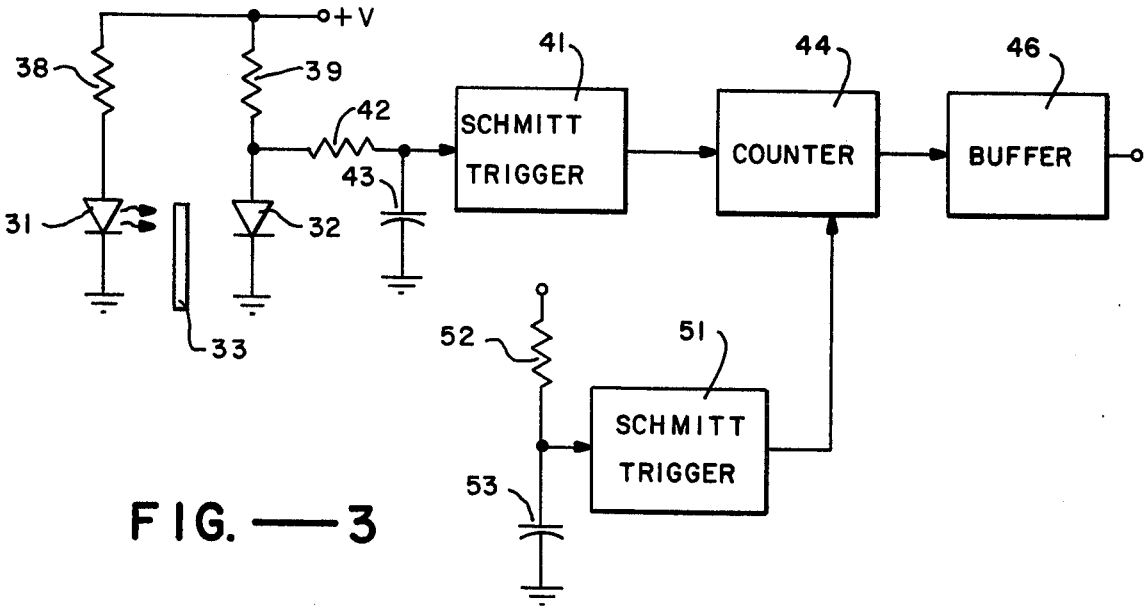
FIG. 3 is a block diagram of the price encoder shown in FIGS. 1 and 2.

Electronic circuitry for processing the signals from photodiode 32 is mounted in a package 36 on base arm 19 and illustrated in FIG. 3. Alternatively, if desired, this circuitry can be located remotely of the pump.

As illustrated, LED 31 and photodiode 32 are connected to a voltage source +V through resistors 38, 39. The pulses produced by photodiode 32 are applied to a Schmitt trigger 41 through a low-pass filter consisting of a resistor 42 and a capacitor 43. The output of the Schmitt trigger is connected to the clock input of a counter 44, and the output of the counter is connected to the input of a buffer amplifier 46 having a low output impedance suitable for connection to recording, totalizing or other processing equipment at a remote location.

In the preferred embodiment, the encoder disc and the ratio of gears 21, 24 are selected to provide an output from photodiode 32 of ten pulses per penny of gasoline dispensed, and counter 44 is a decade counter which delivers output pulses at the rate of one pulse per penny at the overflow output. By monitoring the weighted outputs of the counter and delivering the output pulses when the counter reaches a level of 5, a rounding off to the nearest penny can be effected.

Means is provided for resetting counter 44 to its initial level whenever operating power is applied to the encoder. This means includes a second Schmitt trigger 51 connected to the reset input of the counter and an RC network 52, 53 connected between the voltage source and the input of the Schmitt trigger.

Operation and use of the encoder can now be described. It is assumed that the encoder is mounted on the price computer of a gasoline pump in the manner illustrated and that the gear ratio and encoder disc have been selected to provide a signal from photodiode 32 of ten pulses per penny of gasoline dispensed. When the pump is turned on and operating power is applied to the encoder, Schmitt trigger 51 delivers a reset pulse to counter 44. The duration of this pulse is determined by the time constant of RC network 52, 53.

The low-pass filter consisting of resistor 42 and capacitor 43 removes any unwanted high frequency disturbances from the photodiode signal, and the pulses produced by the photodiode are squared by Schmitt trigger 41. Counter 44 delivers one output pulse in response to every ten input pulses, i.e. one pulse per penny of gasoline dispensed. If rounding off is desired, the output pulses are delivered when the counter reaches a level of 5. Otherwise, the output pulses are delivered when the counter overflows.

The invention has a number of important features and advantages. It can be utilized with the mechanical price computers found in existing pumps for gasoline and other petroleum products to provide an output signal having an accurate relationship to the product flow. By generating input pulses at a higher rate than required for the output and then dividing to provide the desired output rate, a high degree of accuracy is assured. The accuracy is further enhanced by resetting the counter automatically at the outset of each delivery.

It is apparent from the foregoing that a new and improved gasoline pump price encoder has been provided. While only one presently preferred embodiment has been described, as will be apparent to those familiar with the art, certain changes and modifications can be made without departing from the scope of the invention as defined by the following claims.

What is claimed is:

1. In an encoder for use with a flow responsive mechanical computer having a gear which rotates at a rate bearing a predetermined relationship to the flow and a stationary frame member spaced from the gear: a base adapted to be removably mounted on the frame member with a bearing surface for engagement with said member in such manner that the base is free to pivot about the member, a gear rotatively mounted on the base and spaced from the bearing surface for driving engagement with the computer gear means yieldably urging the base to pivot about the stationary member to maintain the gears in driving engagement when the encoder is mounted on the computer, and means coupled to the encoder gear for delivering a digital output signal corresponding to the rate at which said gear is driven.

2. The encoder of claim 1 wherein the means urging the base to pivot comprises a spring connected between the encoder and the computer.

3. The encoder of claim 1 wherein the means for delivering an output signal includes a light source and a light responsive device mounted on the base and a encoder disc constrained for rotation with the encoder gear for alternately passing and blocking light between the source and light responsive device as the gear rotates.

4. The encoder of claim 1 wherein the means for delivering an output signal includes means for generating pulses at a rate corresponding to the rotation of the encoder gear, a counter responsive to the pulses, and means responsive to the initial application of operating power to the encoder for resetting the counter to an initial level.

5. The encoder of claim 1 wherein the bearing surface of the base comprises a generally semi-cylindrical surface.

6. The encoder of claim 1 wherein the base comprises first and second generally planar arm portions on which the encoder gear and the means for delivering an output signal are mounted and a semi-cylindrical portion forming the bearing surface between the arm portions.

* * * * *